United States Patent [19]

Goodman et al.

[11] Patent Number: 4,930,780

[45] Date of Patent: Jun. 5, 1990

[54] DICE GAME

[76] Inventors: Van R. Goodman; Maxine Goodman, both of 2425 Jan Dr., Memphis, Tenn. 38127

[21] Appl. No.: 315,603

[22] Filed: Feb. 27, 1989

[51] Int. Cl.[5] ..... A63F 9/04

[52] U.S. Cl. ..... 273/146

[58] Field of Search ..... 273/146, 148 R

[56] References Cited

U.S. PATENT DOCUMENTS

| | | | |
|---|---|---|---|
| 4,469,329 | 9/1984 | Guyer | 273/146 |
| 4,648,602 | 3/1987 | Maroney | 273/146 |
| 4,834,386 | 5/1989 | Rosenthal et al. | 273/146 |

*Primary Examiner*—Anton O. Oechsle

*Attorney, Agent, or Firm*—Richard C. Litman

[57] ABSTRACT

A method of playing a dice game is disclosed wherein a dice box having two play compartments in separated by a common wall, one compartment of which is used to catch the dice when thrown, the second compartment acting as a holding area in which dice are placed that have been counted in scoring, taking them temporarily out of action. The game is played with six dice. Ones, fives and certain multiple combinations are scored. Players may rethrow any dice which miss the play compartment, and any score changes being caused by one die hitting another in the play compartment are counted. A player must voluntarily surrender his turn while still accumulating score in order for that score to be counted; if he fails to score on any throw of the dice, any score accumulated during that turn is canceled.

7 Claims, 1 Drawing Sheet

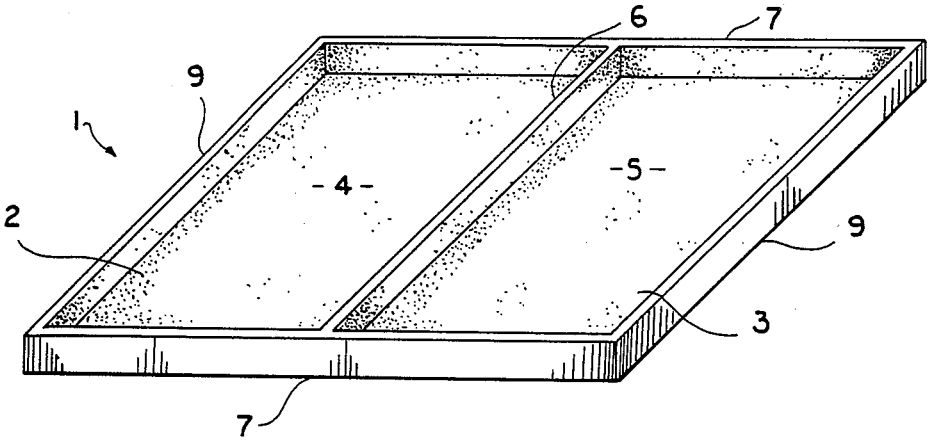
FIG. 1
FIG. 2
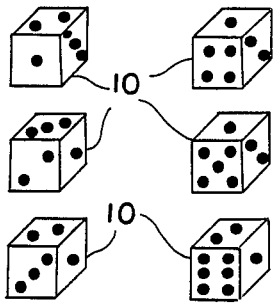
11
| ROUND | PLAYER 1 | 2 | 3 | 4 | 5 | 6 |
|---|---|---|---|---|---|---|
| 1 | | | | | | |
| 2 | | | | | | |
| 3 | | | | | | |
| 4 | | | | | | |
| 5 | | | | | | |
| 6 | | | | | | |
12 13
FIG. 3

DICE GAME

FIELD OF THE INVENTION

This invention relates generally to a game apparatus and method of play for playing a dice game, and more particularly to a game with three stages of play using six dice.

BACKGROUND OF THE INVENTION

Games of chance employing dice are as old as the invention of dice themselves. The concept of using dice boxes in which to play dice games is also old. Even so, the prior art discloses many novel dice box apparatuses and many novel dice games to be played in them.

U.S. Pat. No. 2,657,065 is one such game wherein dice are projected at a cylindrical chamber, the score being determined by the score on the dice which hit the chamber. U.S. Pat. No. 4,247,114 discloses a game board with a walled center player area. U.S. Pat. No. 4,648,602 discloses a hexagonal dice box, with a circumferential rim on which score may be kept.

Dice throwing into a dice box can occasionally result in a miss, wherein the dice miss the box or fly out of it after being thrown. When this happens, the dice are usually retrieved and thrown again. However, a game such as the present invention which allows the player an opportunity to improve his score when he throws again, combined with a double dice box provides a novel and entertaining way to play dice.

SUMMARY OF THE INVENTION

By the present invention, an improved dice game is disclosed using a unique play board and six dice of the standard variety each having six square faces, numbered consecutively from one to six.

Accordingly, one of the objects of the present invention is to provide a dice game wherein throwing dice against dice already thrown to move them and change the score is part of the game strategy.

Another object is to provide a game wherein the greed of the players is balanced off against the risk of losing score for being excessively greedy.

Yet another object is to provide two play dice boxes, either suitable for use as a dice board into which the dice are thrown, the other acting to hold previously thrown dice that are out of play.

A further object of the present invention is to provide a game with three stages of play, in which a certain minimum score is required in the first stage for a player to advance to the next stage.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 1 is a perspective view of a dice box with two compartments comprising a portion of the dice game apparatus as the present invention.

FIG. 2 is a perspective view of the six die cubes comprising another portion of the dice game apparatus of the present invention.

FIG. 3 is a partial plan view of the arrangement of the indices on the tally sheet of the present invention.

Similar reference characters designate corresponding parts throughout the several figures of the drawings.

DESCRIPTION OF THE PREFERRED EMBODIMENT

The game apparatus of the present invention is shown in FIGS. 1, 2, and 3, FIG. 1 being a dice box 1 having a first compartment 2 and second compartment 3, each compartment being generally rectangular in shape and having vertical end walls 7, vertical side walls 9 and a common wall 6 dividing them. The floor 4 of first compartment 2 and floor 5 of second compartment 3 are covered with felt or similar material to cushion the rebound of the dice.

Six dice 10 as shown in FIG. 2 are used to play the game, each die 10 being of the standard cubical variety having the values 1, 2, 3, 4, 5 and 6 on each face with spots or dots, the number of dots directly corresponding to the value, one set of dots per face.

Score is kept on a tally sheet 11 as shown in FIG. 3, wherein the leftmost column 12 contains the number of the round played, and the remaining columns 13 contain the scores of the individual players, arranged from left to right in the order of play from first to last.

The game consists of three stages and ma be played by two or more players. Before the actual game begins, the order of play is determined by having each player toss a single die. The player achieving the highest number is allowed to play first. The scorekeeper may also be selected in this manner. Players achieving lower numbers will follow, in order of the number rolled, the first player. Any players with ties continue to roll the individual die until the ties are broken. The order of players and play is then noted across the top of the score sheet 11.

Play proceeds in rounds, beginning with a first player and continuing in order to a last player, a new round beginning each time the last player completes his turn.

Once the order of play has been determined, the point value is scored based on the numbers displayed on the dice when thrown, as shown in the table immediately below:

Single 1's=100
Single 5's=50
Three 1's=1000
Three 2's=200
Three 3's=300
Three 4's=400
Three 5's=500
Three 6's=600
Six 1's=2000
Six 2's=400
Six 3's=600
Six 4's=800
Six 5's=1000
Six 6's=1200
1, 2, 3, 4, 5, 6=1650

At the start of the game, all players are "off-board", in which state they may not keep any score accumulated. Score may only be accumulated after a player gets "on-board." The first stage of the game consists of players attempting to get "on-board," which status allows players to accumulate points on the score sheet 11 as outlined above.

To get "on-board", an "off-board" player must score a minimum of 500 points as determined above. In order to get "on-board" a player must also score at least 50 points more than the previous player who succeeded in getting "on-board".

Play begins with first designated player, who throws all six dice 10 into the first tray 2 of the two trays 2 and 3 of the game tray 1. All scoring or winning dice 10, if any, must be transferred from the first side 2 of the game tray 1, to the second side 3. If the player was able to score any points on his first throw he may now take a second turn, throwing the dice 10 which remained in the first tray 2 after the transfer of any scoring dice, but not the dice 10 in the second tray 3. Any winning dice 10 are again transferred to the second tray 3 and any remaining dice 10 may be thrown again. The only exception to this rule is for single 5's, which, when thrown, may be kept and thrown again, without being scored.

Once a player has met or exceeded the minimum number of points required to get "on-board" as described above, that player may advance to the second stage of the game and that player's score may be placed in the appropriate column on the score sheet 11.

A player may continue to play as long as he continues to score points. If he manages to score points with each or all of the six dice at his disposal on one or more throws and thereby has placed all of his dice on the right side 3 of the tray 1, he may start again by collecting all six dice 10 and continuing to play.

In order for a player to have his score noted and counted on the score sheet for his turn, that player must stop while he is still winning, i.e., scoring points, declare himself finished and have his score added on the tally board 11. If he continues to play until he loses, i.e., fails to score any points on a given toss of the dice 10, he loses his turn and any score he has accumulated during that particular turn.

However, each player must also achieve a score at least 50 points higher than the previous player in order for his score to be recorded on the score sheet, in a similar manner to the rules of play for the first stage of the game when players are attempting to get "on-board."

Dice 10 which do not land in the proper compartment 2 when first thrown must be gathered up and thrown again into the first compartment 2 until all dice 10 have landed there. If some of the dice 10 are inadvertently thrown so as to enter compartment 3 of tray 1 and thereby contact and move any other dice 10 which have been transferred to that compartment 3, thereby causing their score to change, the new score is the one kept.

Play continues in rounds, each new round beginning with first player and continuing in sequence until last player has completed his play, whereupon first player begins the next round.

The game enters the third stage when one player achieves a score of 10,000 or more. When this occurs, all the remaining players in the round are also given their turns, and the one with the highest score at the end of this last round wins. Players in the round who preceded the player who first achieved 10,000 are not given a turn and are automatically out of the game. As an example, if there are 5 players in the game and player 3 is the first to exceed 10,000 points, then only players 3, 4, and 5 may remain in the game for the third and final stage. Players 1 and 2 are automatically out of the game.

It is to be understood that the present invention is not limited to the sole embodiment described above, but encompasses any and all embodiments within the scope of the following claims.

We claim:

1. A method of playing a dice game for two or more players utilizing a dice box, six dice and a score sheet which comprises the following steps:

(a) establishing by chance means an order of play whereby players are designated first player, second player and so one to a last player, (b) initiating first stage of play by throwing said dice and playing in rounds beginning with said first player and ending with said last player whereupon each of said players in turn throws said line in an attempt to achieve sufficient score to enter a second state of the game, (c) continuing to play in rounds, said players who have entered said second stage of the game now throwing said dice to accumulate scores, (d) each of said players must exceed the score of the previous player by a predetermined number of points in order to progress at the first or second stage of the game, (e) playing a final stage and round which begins when one of said players reaches a predetermined high score, the remaining players playing to exceed this score to win.

2. A method of playing the dice game of claim 1 wherein, said dice box is divided into a first compartment and a second compartment of equal size.

3. A method of playing the dice game of claim 2 wherein, said players must throw said dice into said first compartment to achieve score.

4. A method of playing the dice game of claim 3 wherein, said players must place all of said dice which may be counted toward score into said second compartment to remove them from play.

5. A method of playing the dice game of claim 4 wherein, said dice which are thrown outside said first compartment are thrown again, any score change caused by said thrown dice impacting said dice remaining within said second compartment being final.

6. A method of playing the dice game of claim 1 wherein, a player must voluntarily surrender his turn while still accumulating points in order for any points accumulated during that turn to be scored.

7. A method of playing the dice game of claim 1 wherein, a player failing to score any points on a given throw of the dice thereby loses his turn, as well as any points said player may have accumulated according to previous throws of said dice during that turn.

* * * * *